US005918498A

United States Patent [19]

Robbins

[11] Patent Number: 5,918,498

[45] Date of Patent: Jul. 6, 1999

[54] DUMMY BLOCK CONSTRUCTION

[76] Inventor: Paul H. Robbins, 5 Springmaple Chase, Aurora, Ontario L4G 6X1, Canada

[21] Appl. No.: 08/863,100

[22] Filed: May 23, 1997

Related U.S. Application Data

[63] Continuation-in-part of application No. 08/683,268, Jul. 18, 1996, Pat. No. 5,771,734.

[51] Int. Cl.[6] ..... B21C 25/00

[52] U.S. Cl. ..... 72/273

[58] Field of Search ..... 72/273, 273.5, 72/272, 253.1, 478

[56] References Cited

U.S. PATENT DOCUMENTS

| | | | |
|---|---|---|---|
| 2,904,830 | 9/1959 | Mulrooney . | |
| 2,925,176 | 2/1960 | Wyngaert | 72/273 |
| 3,282,074 | 11/1966 | Gardner . | |
| 3,282,075 | 11/1966 | Zhookoff . | |
| 3,303,684 | 2/1967 | Starr et al. . | |
| 3,385,091 | 5/1968 | Hess . | |
| 3,581,544 | 6/1971 | Grimes . | |
| 3,616,672 | 11/1971 | Moos . | |
| 3,630,064 | 12/1971 | Mahns . | |
| 3,820,374 | 6/1974 | Braeuninger . | |
| 3,826,122 | 7/1974 | Braeuninger . | |
| 3,831,418 | 8/1974 | Bogdanov et al. . | |
| 3,908,427 | 9/1975 | Wozniak et al. . | |
| 3,919,873 | 11/1975 | Biswas et al. . | |
| 3,977,226 | 8/1976 | Mann et al. . | |
| 4,024,743 | 5/1977 | Decours et al. . | |
| 4,052,877 | 10/1977 | Zilges et al. . | |
| 4,212,182 | 7/1980 | Steyvers et al. . | |
| 4,286,453 | 9/1981 | Exner . | |
| 4,342,212 | 8/1982 | Sibler . | |
| 4,550,584 | 11/1985 | Degen . | |
| 4,714,423 | 12/1987 | Hattori et al. . | |
| 5,048,592 | 9/1991 | Mueller . | |
| 5,054,303 | 10/1991 | Newman . | |
| 5,272,900 | 12/1993 | Robbins . | |
| 5,311,761 | 5/1994 | Robbins . | |
| 5,626,047 | 5/1997 | Bello | 72/273 |

FOREIGN PATENT DOCUMENTS

| | | | |
|---|---|---|---|
| 1190518 | 7/1985 | Canada . | |
| 0 187 582 | 7/1986 | European Pat. Off. . | |
| 1032206 | 6/1958 | Germany . | |
| 4132810 | 8/1988 | Germany . | |
| 4001633 | 7/1991 | Germany | 72/273 |
| 62 248508 | 10/1987 | Japan . | |
| 0137514 | 6/1988 | Japan . | |
| 03 110015 | 5/1991 | Japan . | |
| 3-110015 | 5/1991 | Japan | 72/273 |
| 3-238118 | 10/1991 | Japan | 72/273 |
| 5-76927 | 3/1993 | Japan | 72/273 |
| 0569354 | 8/1977 | U.S.S.R. . | |
| 0593766 | 2/1978 | U.S.S.R. . | |
| 0668738 | 7/1979 | U.S.S.R. . | |
| 0852400 | 8/1981 | U.S.S.R. . | |
| 0897361 | 1/1982 | U.S.S.R. . | |
| 0946714 | 7/1982 | U.S.S.R. . | |
| 954126 | 4/1964 | United Kingdom | 72/273 |
| 2067944 | 8/1981 | United Kingdom | 72/273 |

*Primary Examiner*—Joseph J. Hail, III
*Assistant Examiner*—Ed Tolan
*Attorney, Agent, or Firm*—Young & Basile, P.C.

[57] ABSTRACT

In a dummy block construction for use in extruding an extrudable metal, the dummy block having a dummy block base; a connector for connecting said dummy block base to a stem of an extruder; a replaceable wear ring connected to a forward circumferential portion of said dummy block base; a device for releasably securing said wear ring to said dummy block base; a device for expanding said ring to engage a billet container inside wall of an extrusion press during extrusion of a billet of extrudable metal through such extrusion press, the improvement being characterized in the wear ring being a metal collar having a conical interior surface converging towards said dummy block base; and the device for expanding the ring comprising a metal plunger having a plunger head with a conical surface for engaging the collar conical surface to expand the collar as said plunger head is forced into the collar during extrusion; the converging surfaces of the collar and the plunger head extending a sufficient distance to permit telescoping of the plunger head into the collar to an extent whereby the collar is expanded to engage the billet container inside wall.

7 Claims, 9 Drawing Sheets

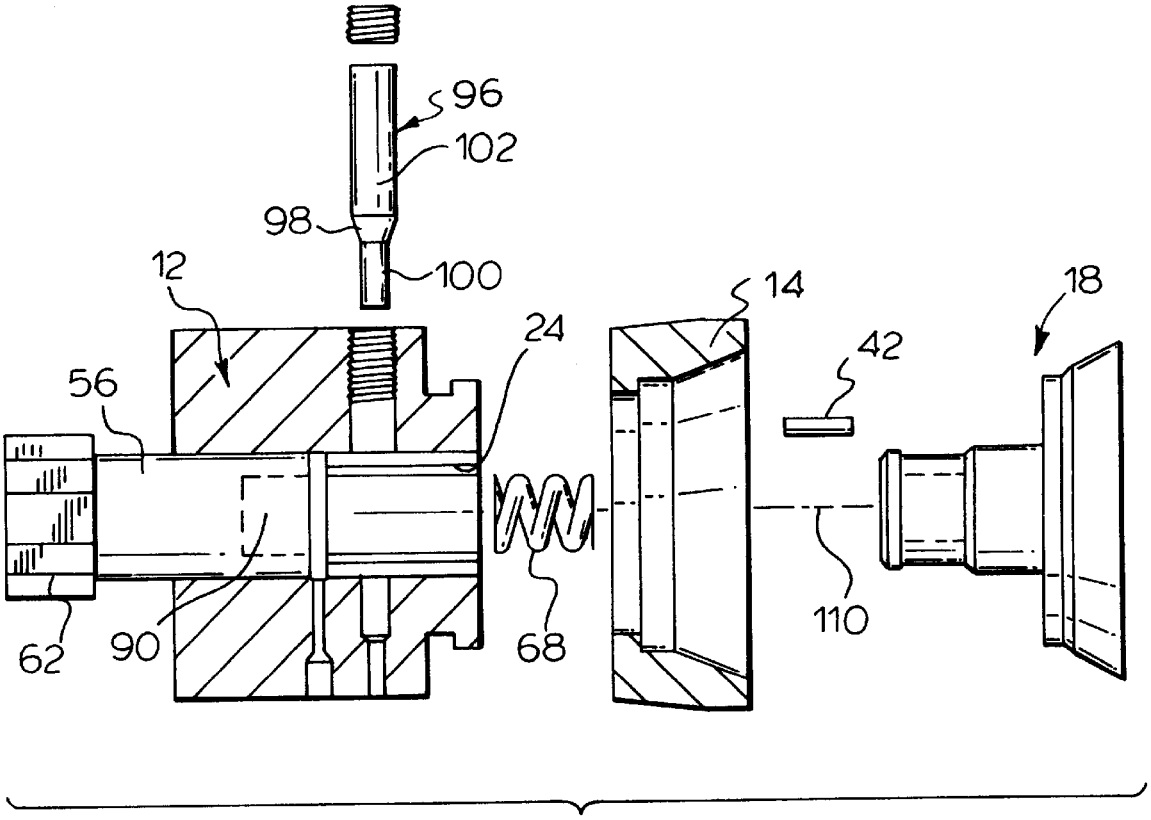
FIG. 3.
FIG. 4.
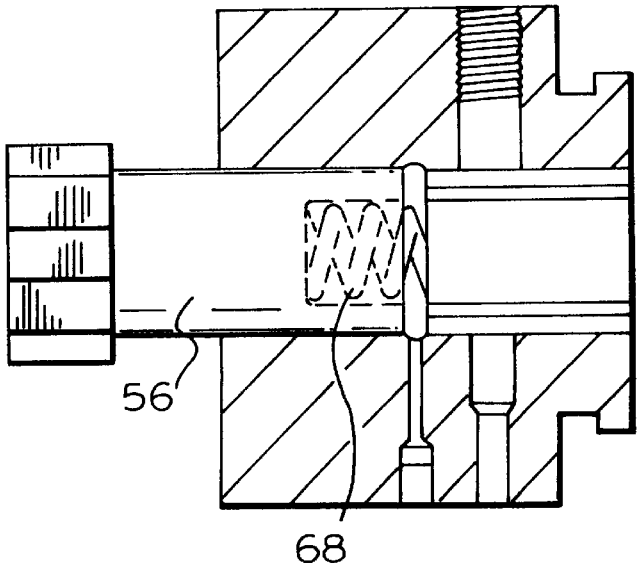

FIG. 11.
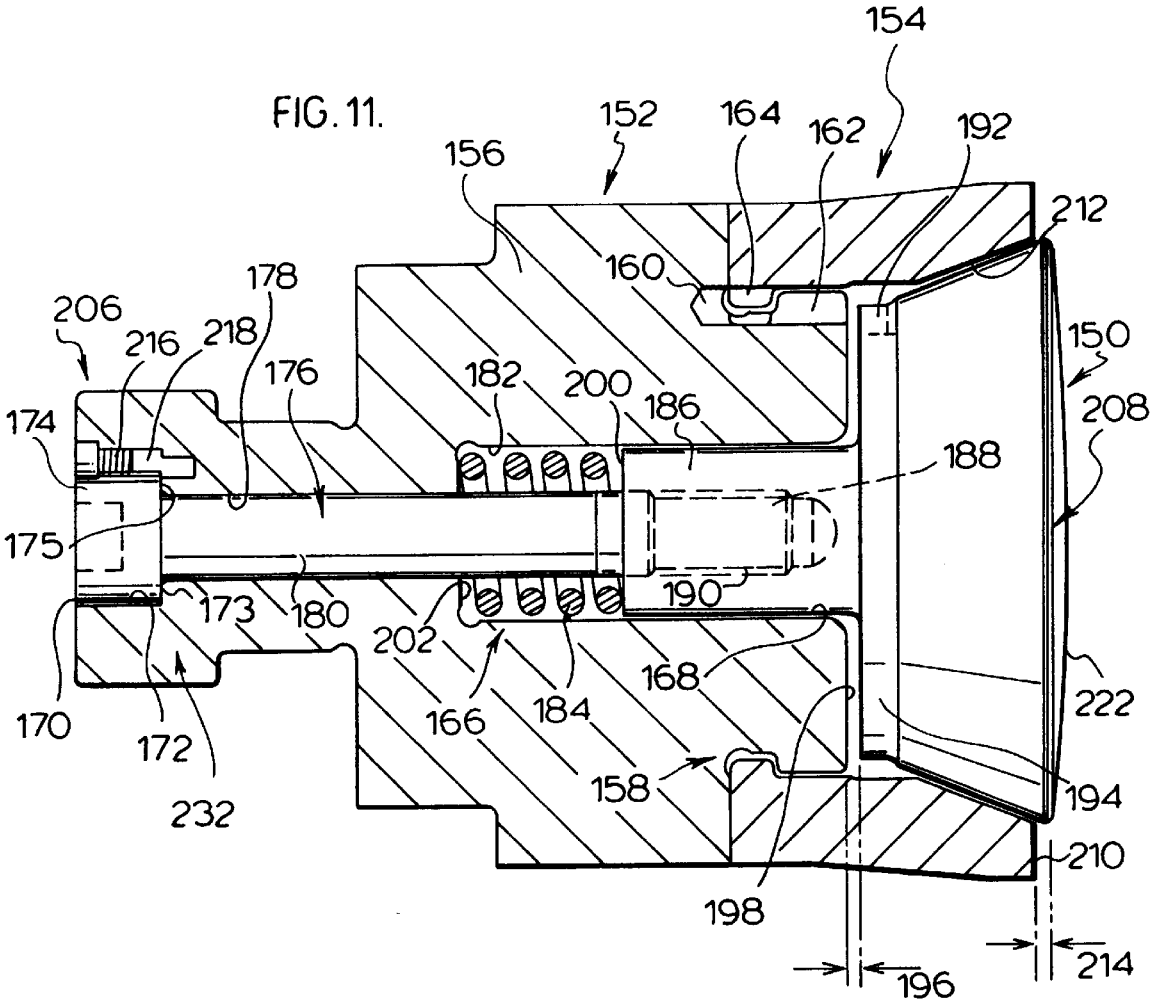
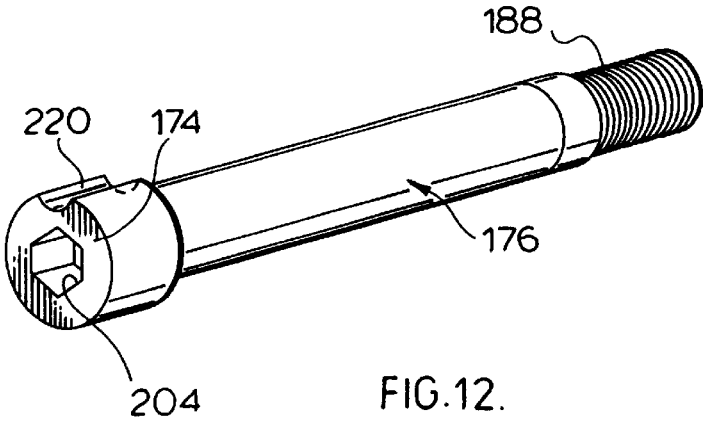
FIG. 12.

DUMMY BLOCK CONSTRUCTION

This application is a continuation-in-part of U.S. Ser. No. 08/683,268 now U.S. Pat. No. 5,771,734 filed Jul. 18, 1996.

FIELD OF THE INVENTION

This invention relates to a dummy block construction having an improved replaceable wear ring system and alternative assembly systems.

BACKGROUND OF THE INVENTION

The dummy block construction as described in applicant's U.S. Pat. Nos. 5,272,900 and 5,311,761 provide a venting device for the dummy block and a bayonet type connector for connecting the dummy block to a stem of an extrusion press. The venting device which is more commonly referred to as a plunger is pushed inwardly of the dummy block when the dummy block abuts a billet of extrudable metal in a container of an extrusion press. When the venting device is closed it expands slightly the dummy block circumference to contact the interior surface of the container to preclude thereby metal flashing beyond and behind the dummy block face. With correct machining of the dummy periphery and positioning of the plunger, the dummy block periphery can be expanded to the extent desired to minimize metal flashing. However, over extended periods of use, the circumferential portion of the dummy block looses its strength and hence fails to seal the face of the dummy block to the container interior, hence metal flashing becomes a problem. Also, as the circumferential portion of the dummy block looses its strength, the plunger may wedge and become jammed within the dummy block, so that it does not release when the dummy block is retracted from the container of the extrusion press. It is then necessary to return the dummy block for refurbishing and retooling whereby the refurbished dummy block has a circumferential forward portion which exhibits the desired strength characteristics to minimize flashing and minimize jamming of the plunger within the dummy block.

Although the above type of dummy block construction is particularly suited to the extrusion of various extrudable metals which include aluminium alloy, copper, bronze, brass and the like, various attempts have been to solve the problem associated with the above type of dummy block. Various types of wear rings have been provided on the dummy block, for example, U.S. Pat. No. 4,024,743 describes a compressible, expandable seal for use in a piston extrusion of hot or cold metal billet. The seal is designed to flow outwardly of the plunger and contact is the container to prevent flashing of metal beyond and behind the plunger. This system normally hangs up on the butt portion of the billet in the container, so that when the plunger is withdrawn, the seal is destroyed which requires replacement. A bolt may be used as it extends through the dummy block components to squeeze the seal between the dummy block components.

U.S. Pat. No. 3,977,226 describes a floating ring seal for extruding metals. The floating ring seal has the same problem as the seal in U.S. Pat. No. 4,024,743. When the ram is withdrawn from the container, the seal will hang up on the butt of the billet of extruded metal, requiring clean out of the extrusion container.

U.S. Pat. No. 3,831,418 describes a dye assembly for extruding aluminium and its alloys. The dye assembly includes a ring at the face of the dye assembly and which is expanded outwardly by inwardly sloping surfaces converging towards the front of the dye assembly. This requires that the ring move rearwardly of the edge assembly in order to expand and engage container wall thereby exposing a portion of the front of the dye assembly. Due to this movement of the ring in the reverse direction along the dye assembly, gaps may be created through which metal may flash beyond and behind the dye assembly. This causes significant problems with respect to removal of the dye assembly from the extrusion container. With either the interlocking engaging teeth or bayonet style connection of the ring to the dye assembly, the ring in moving rearwardly does not expand readily because of the low surface area of the ring which has exposed the metal billet and hence further metal flashing may be a problem around the perimeter of the dye assembly.

Russian Patent 569,354 describes a dummy block system for metal extruders which has a conical ring with a conical outside surface for expanding the ring as the dummy block contacts the billet of material in the extruder container. The ring is thin and is caused to expand by sliding rearwardly on a sloping face of the dummy block. A forward portion of the dummy block is slidably mounted to move rearwardly and push the ring up the sloped surface. The face of the dummy block has a indentation where the metal portion which moves the ring rearwardly has to advance onto the dummy block structure.

This as well can cause significant metal flashing problems where the pressures within the container can exceed upwardly of 100,000 psi. Any clearance at all will result immediately in metal flashing and thereby block the extraction of the dummy block from the extruder container. Furthermore, with the relative slope of the ring to the dummy block surfaces, there is a greater likelihood of jamming because the angle of the sloping surfaces is considerably less than 20° from the longitudinal axis of the dummy block. This can also result in the ring jamming and staying expanded and thereby further hindering the extraction or withdrawal of the dummy block from the extruder container.

German Patent Application 4,132,810 describes a dummy block construction for a metal extruder where the seal arrangement is like that described in U.S. Pat. No. 4,024,743. The dummy block has a central piston with a convex shaped face. The piston is moved rearwardly into the dummy block to expand the seal and engage thereby the container interior surface. The seal has a tendency to hang up on the interior of the container at the completion of an extrusion cycle. Furthermore, the piston can yield which would inherently reduce the extent of expansion of the seal and thereby result in a significant problem regarding metal flashing passing beyond and behind the dummy block.

Other systems for expanding the dummy block perimeter to engage the extrusion container interior wall are described in U.S. Pat. Nos. 3,919,873 and 4,550,584. As already discussed the problem with the system of U.S. Pat. No. 4,550,584 is that the metal of the dummy block body portion fatigues, requiring replacement of the entire block body portion. As to the system of U.S. Pat. No. 3,919,873, a convex indentation is provided in the face of the dummy block to encourage expansion of the dummy block. In the alternative the telescoping of a disk within the dummy block face can be relied on to expand the dummy block. A bolt is used to hold the disk to the face of the dummy block where resilient devices bias the disk to the outward position.

In applicant's aforementioned U.S. Pat. No. 5,272,900, the system is set up to position the spring between the bayonet connector post and the end of the plunger post. This arrangement facilitates access to the rear of the plunger so that the plunger could be removed from the dummy block and also biased the bayonet connector to study it for purposes of assembly to the extruder stem. This arrangement involves a number of component parts which involve extra machine time and in particular involves expensive threading within the dummy block per se.

Accordingly, this invention overcomes a number of the above problems by providing an improved wear ring on the dummy block which is substantial in form and constitutes a replaceable collar about the forward portion of the dummy block. An improved design with respect to a plunger which enters the dummy block during the extrusion process ensures a consistent reproducible expansion of the collar to seal the container interior and thereby minimize metal flashing beyond and behind the dummy block and as well minimize jamming of the plunger within the dummy block by virtue of the expanded collar.

SUMMARY OF THE INVENTION

According to an object of the present invention there is provided a dummy block construction for use in extruding an extrudable metal, the dummy block having:

i)a dummy block base;

ii)means for connecting the dummy block base to a stem of an extruder;

iii)a replaceable wear ring connected to a forward circumferential portion of the dummy block base;

iv)means for releasably securing the wear ring to the dummy block base;

v)means for expanding the ring to engage a billet container inside wall of an extrusion press during extrusion of a billet of extrudable metal through such extrusion press;

the improvement being characterized in:

vi)the wear ring being a metal collar having a conical interior surface converging towards the dummy block base;

vii)the means for expanding the ring comprising a metal plunger having a plunger head with a conical surface for engaging the collar conical surface to expand the collar as the plunger head is forced into the collar during extrusion;

viii)the plunger head having a substantially planar face and the collar having a forward substantially planar face;

ix)the converging surfaces of the collar and the plunger head extending a sufficient distance to permit telescoping of the plunger head into the collar to an extent which expands the collar to engage such billet container inside wall whereby the plunger face is essentially planar with the face of the collar.

According to yet another object of the present invention there is provided a dummy block construction for use in extruding an extrudable metal, the dummy block having:

i) a dummy block base;

ii) means for connecting the dummy block base to a stem of an extruder;

iii) a metal plunger for expanding the dummy block to engage a billet container inside wall of an extrusion press during extrusion of a billet of extrudable metal through such extrusion press;

iv) means for mechanically biasing the plunger head to pop outwardly of the dummy block;

v) a bore extending axially through the dummy block;

vi) the biasing means being located in the bore and positioned to bias a plunger post extending into the bore;

the improvement comprising vii) the connecting means being integral with the dummy block base, the bore extending through the dummy block and the connecting means, viii)a bolt having a head and a threaded end extending through the bore and threaded into the plunger post, the bore having means for seating the bolt head in the bore, whereby turning of the bolt retracts the plunger post into the dummy block to tension slightly the biasing means.

BRIEF DESCRIPTION OF THE DRAWINGS

Various embodiments of the invention as described with respect to the drawings wherein:

FIG. 3 is a side elevation of the exploded view of FIG. 1;

FIGS. 4 through 8 are various side elevations showing the assembly of the dummy block construction of FIG. 3;

FIG. 11 is a section through an alternative embodiment for mounting the plunger within the dummy block having a replaceable collar;

FIG. 12 is a side view of the bolt for use in the assembly of FIG. 11;

DETAILED DESCRIPTION OF THE PREFERRED EMBODIMENTS

Figure 1:
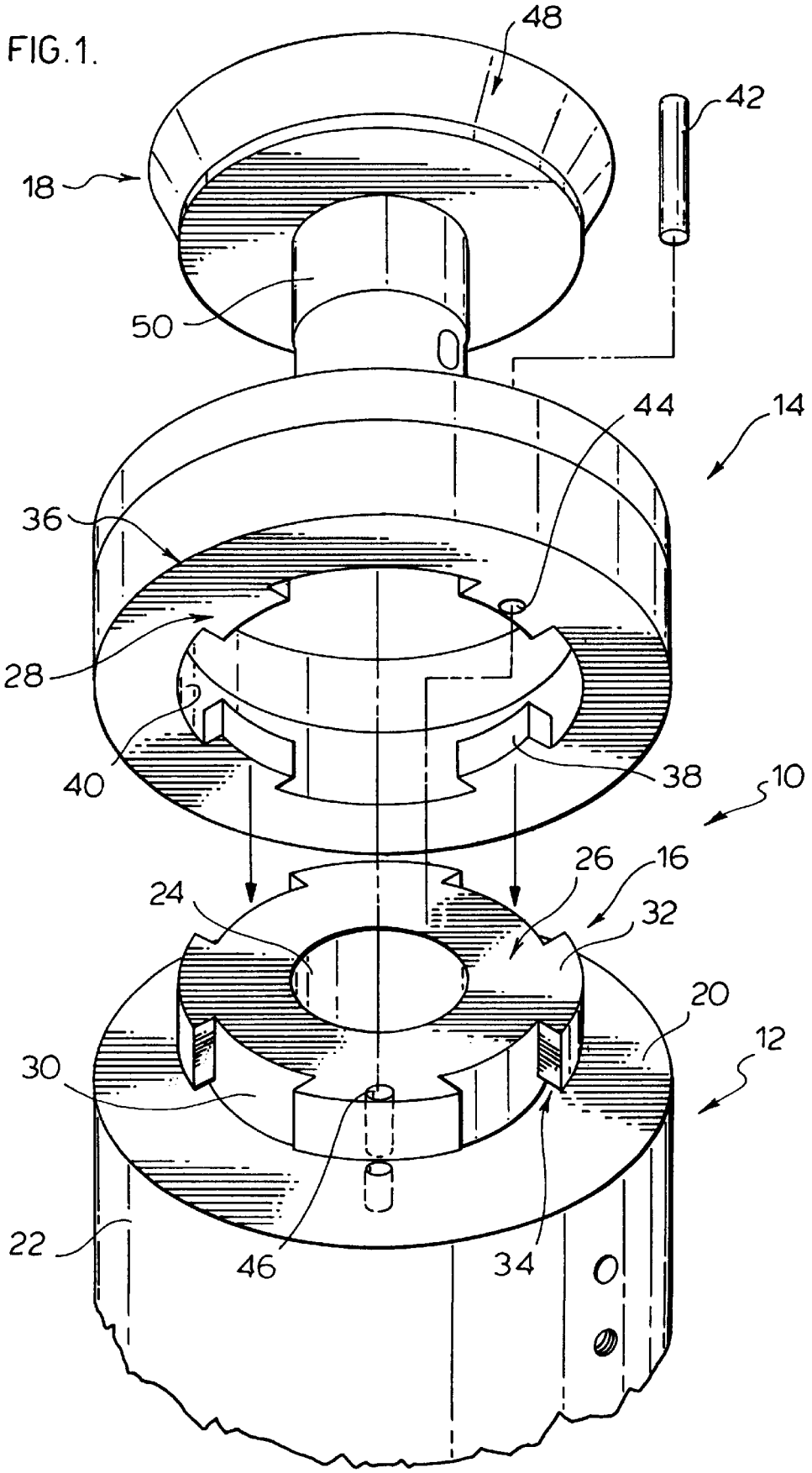
FIG. 1 is an exploded view of a removable collar for a dummy block base.

The removable collar for the dummy block construction of FIG. 1 provides many significant advantages as will become apparent in the discussion of the various embodiments of the invention. In FIG. 1, the dummy block construction 10 has a dummy block base 12, a replaceable collar 14 which is connected to the dummy block base by the bayonet type connector 16 and a plunger 18 which moves within the collar 14 to expand it when the face of the dummy block contacts a billet of metal in the extruder container. In accordance with this particular embodiment, the dummy block base has a planar face portion 20 with a cylindrical body portion 22 into which a bore 24 extends. The bayonet connector 16 has a first component 26 and a second component 28 on the collar 14. The first component 26 is machined from the interior of the body portion 22 to provide an upstanding stud 30 with individual equidistant spaced apart lugs 32.

The lugs 32 are spaced slightly above face 20 as indicated for example by the space in area 34.

The collar 14 has in its base portion generally indicated at 36, the second component 28 of the bayonet connector. The second component comprises a plurality of inwardly extending lugs 38 which project inwardly from interior cylindrical surface 40. The lugs 38 pass between the respective lugs 32 of the first component 26 and fit within the spaces 34 with the collar 14 rotated to position the lugs 38 beneath the lugs 32. A connection of the collar to the dummy block base 12 thereby is provided.

Although the lugs 32 and 38 are shown as approximately equal thickness, it is understood that the sets of lugs 32 and 38 may be of different thickness. To ensure the collar does not rotate and slide off of the dummy block base, a locating and securing pin 42 is passed through a bore 44 in the lug 38 and through the bore 46 of the lug 32 and wedged in place to ensure that the collar remains connected to the dummy block base 12.

The pin 42 may be subsequently removed to permit removal and replacement of the collar 14 as required for the reasons to be discussed in respect of the other Figures.

The plunger 18 has a plunger head portion 48 with a depending plunger post 50. With the collar assembled to the dummy block base the plunger post 50 is inserted through bore 24 and connection completed as will be described with respect to FIGS. 2, 7 and 8.

Figure 2:
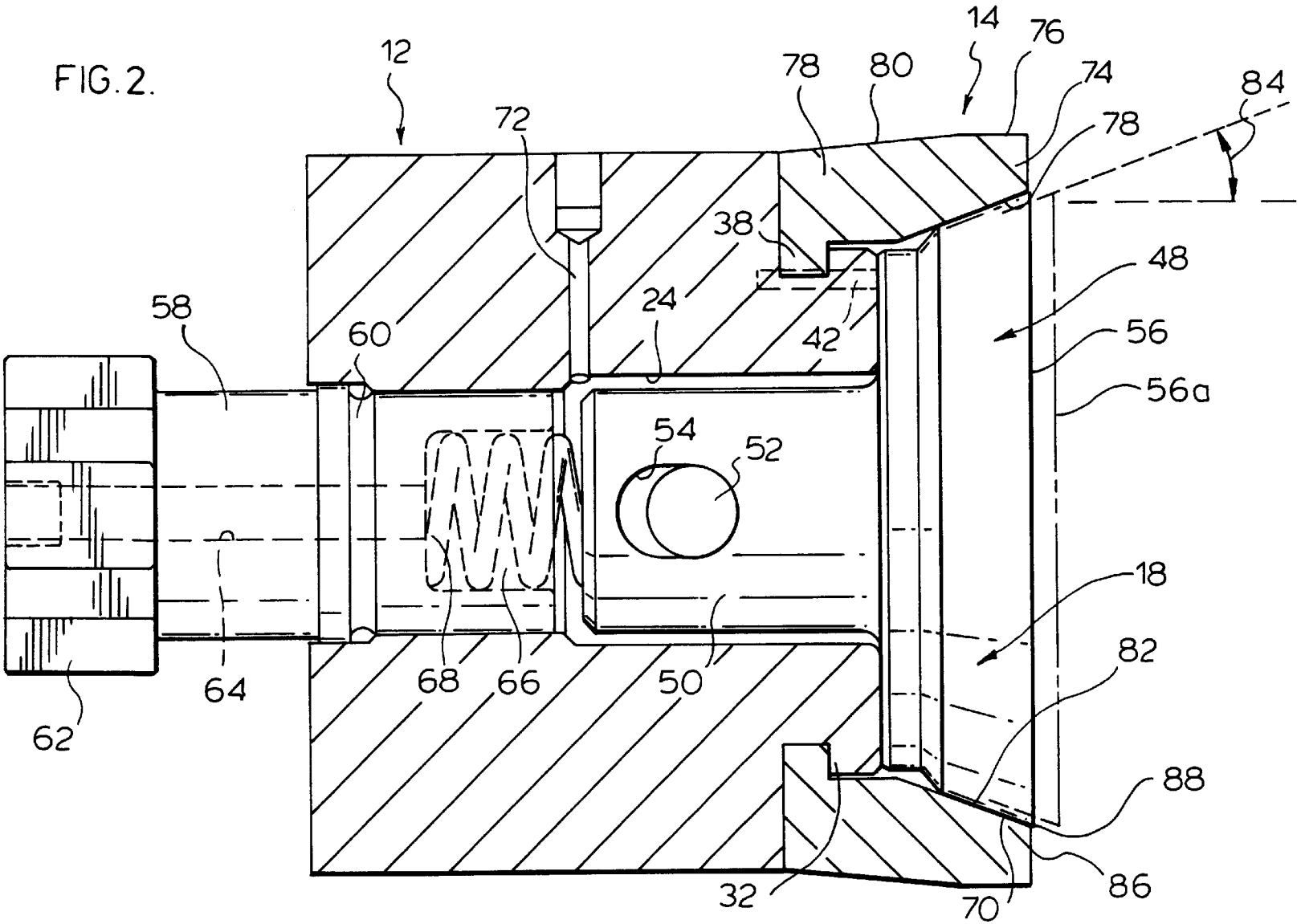
FIG. 2 is a section through the assembled dummy block construction.

FIG. 2 shows a section through the assembled dummy block construction of FIG. 1. The plunger 18 has its post 50 inserted in the bore 24 of the dummy block base 12. A pin 52 extends through an elongate aperture 54 to locate the plunger 18 in the dummy block construction and allows for inward and outward movement of the plunger face 56 between its operating position as shown and its outwardly extended position as shown in dot at 56*a*. Also provided within bore 24 in accordance with this particular embodiment is the separate stud portion 58 which is secured in the dummy block base 12 by a suitable pin inserted in the circumferential groove 60. The stud 58 has a bayonet connector arrangement 62 of the type described in applicant's U.S. Pat. No. 5,272,900 for connecting the dummy block to the stem of the extruder. It is appreciated that other types of connecting devices may be used in connecting the dummy block base 12 to the stem of an extruder. For example, a stud arrangement may be provided as described and shown in applicant's U.S. Pat. No. 5,311,761. Alternative constructions maybe, for example, the use of a connecting rod which extends through and outwardly of the stem into which the dummy block is threaded. It is also understood that other types of connecting devices as are commonly use in connecting the dummy block base to the stem may be employed in conjunction with the features of the replaceable collar of this invention.

This system may also include the necessary venting arrangement to allow air and other gases in the container to escape from between the face of the dummy block and the billet in the container as the dummy block is advanced in the extruder. This feature of venting is described in respect of applicant's U.S. Pat. No. 5,311,761. It is also understood that the dummy block may be cooled by directing air in the opposite direction through an internal bore 64 in the stud 58. The air then flows into the region 66 which houses the spring 68 and can flow over the post 50 and out through the gap 70 defined between the interior surface of the collar 14 and the plunger when the face is in position 56*a*. When the plunger is in the closed position, the air that flows in through bore 64 flows outwardly through a transverse passage 72 of the dummy block. Such flow of air either when the plunger is in the open position or in the closed position provides additional cooling for the dummy block and as well cools the face of the billet when the plunger is in the open non billet contacting position.

The collar 14 is of substantial section and is considerably larger than the prior art wear rings. The collar 14 has a forward portion 74 with an outer surface 76 and an inner surface 78. The collar 14 also has a rearward portion 78 having rearwardly converging surface 80. Portion 78 carries the lugs 38 of the bayonet connector which fit behind lugs 32 of the bayonet connector. The positioning of the pin 42 is shown to hold the collar 14 in place.

The collar interior surface 78 converges rearwardly of the dummy block construction. The plunger head 56 includes a rearwardly converging surface 82 which has a slope as indicated by arrow 84 in the range of 20° to 25°. The slope of the interior surface of the collar is slightly less than the slope of the plunger head to ensure that the two do not become jammed when the plunger assembly is in use. if the slope of the face 82 of the plunger head were the same as the slope of the face 78 of the collar, the faces would jam as the plunger head telescopes within the collar so that when the dummy block is removed from the container, the spring 68 does not have sufficient spring force to pop the plunger out to position 56*a*.

For the reasons described in applicant's U.S. Pat. No. 5,311,761, the spring 68 is provided to pop the plunger 56 outwardly of tie collar 14 to ensure that the dummy block breaks away from the butt of the extruded billet of metal. Also the movement of the plunger in and out of the collar 14 effects the necessary outward expansion of the collar 14 during the extruding process to ensure that metal does not flash beyond and behind the dummy block. As the plunger head 48 telescopes within the collar 14, it causes the ring in the area of body portion 74 to expand circumferentially and cause the surface 76 to come into contact with the interior of the extruder container.

This ensures that metal does not flash beyond the face 86 of the collar. Also it is important to note that with the dimensioning of the collar and movement of the plunger, the face 56 of the plunger is essentially planar with the face 86 of the collar. It is understood of course that depending upon the sizing of the collar and the plunger, it may be that the plunger face 56 is slightly inwardly or outwardly of the collar face 86. Again, the fitting is such to ensure that at the joint 88 of the plunger face with the collar that the space at the joint is essentially imperceptible to prohibit flashing of metal into the joint 88 between the plunger head 48 and the interior of collar 14. in addition, the fitting is such to ensure that the collar is expanded to the desired extent when the dummy block is in operating position where the plunger face is essentially in line with the collar face.

Figure 5:
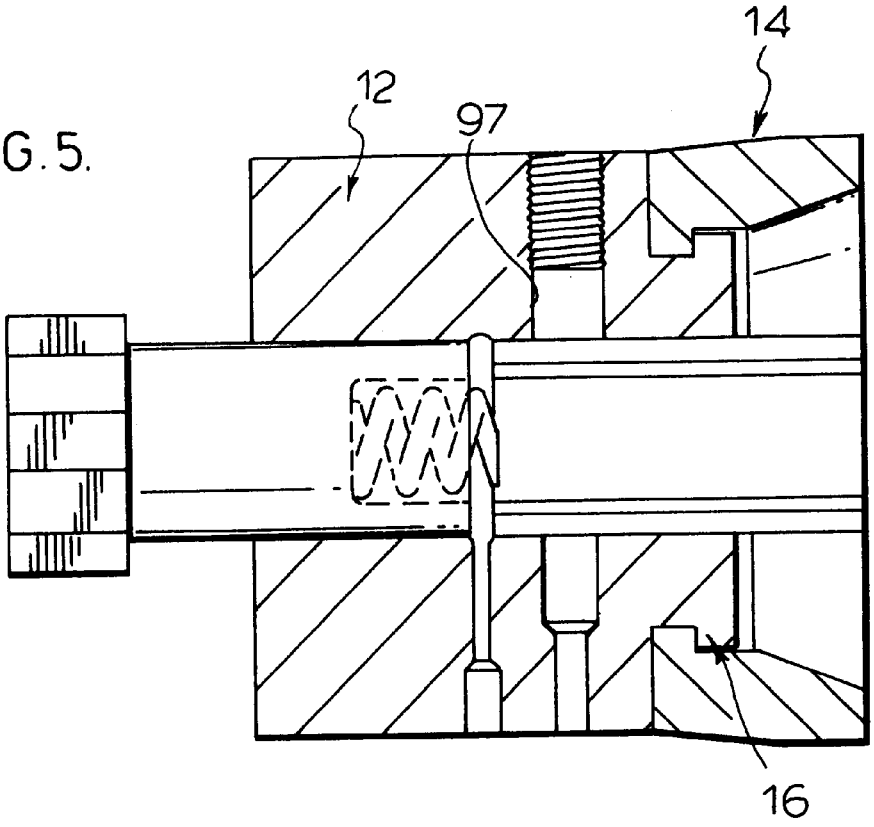
Figure 6:
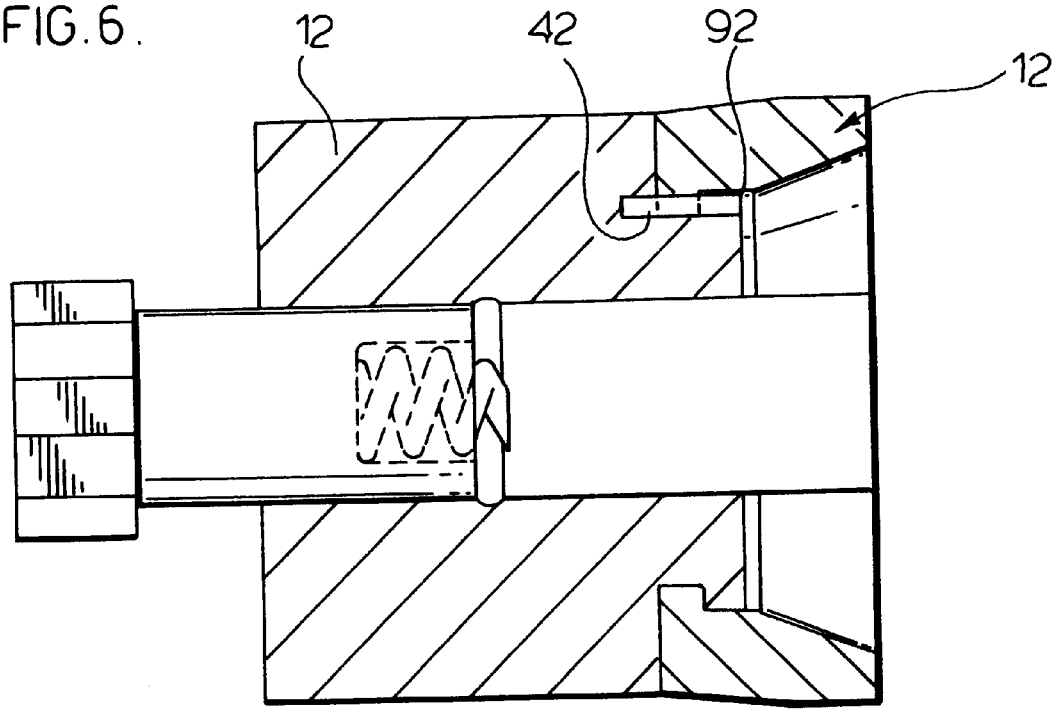
Figure 7:
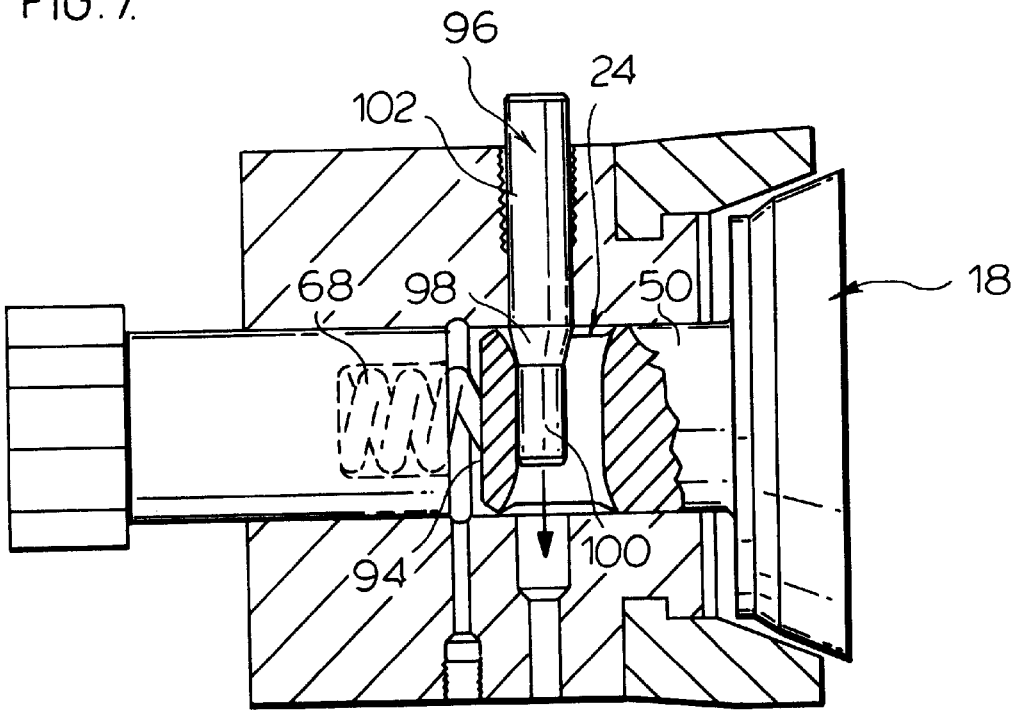

With reference to FIG. 3, the manner in which the components are assembled in accordance with this particular embodiment shall be described. The dummy block base 12 has the stud 56 with bayonet connector 62 mounted therein and held in place by suitable screw connection or the like. The bore 24 of the dummy block base is open and ready to receive the spring 68 to be located in space 90 of the stud 56. The collar 14 and plunger 18 are set aside until the spring is positioned within the stud 56 in the manner shown in FIG. 4. The next step in the assembly is to connect the collar 14 to the dummy block base 12 by way of the bayonet interconnection at 16. The next step in the connection is to locate pin 42 in place and wedge it in region 92 to locate the pin and thereby fix the location of the collar 12 relative to the dummy block base 12. As shown in FIG. 7, the next step is to insert the plunger 18 with its post 50 in the bore 24 such that its end portion 94 abuts the spring 68. A tapered pin 96 is advanced through the passageway 97 as shown in FIG. 5 where the pin 96 has a tapered portion 98 which interconnects the narrower first diameter portion 100 to the larger second diameter portion 102 of the pin 96.

Figure 8:
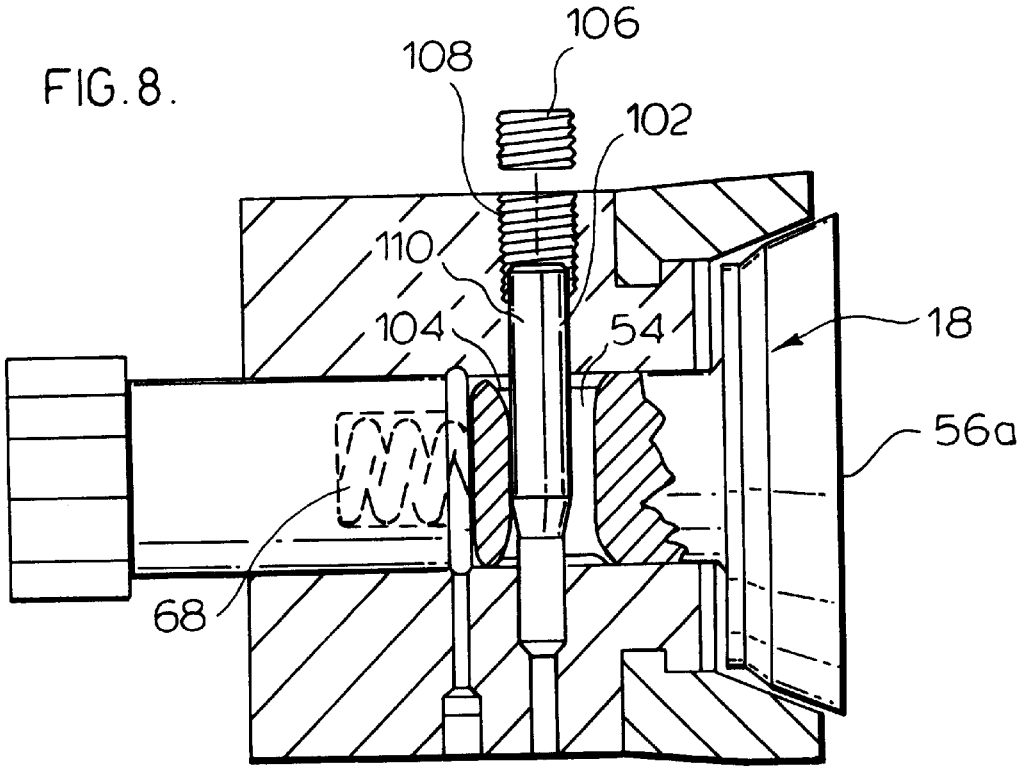

As the pin is advanced into the passageway 97, the tapered land portion 98 abuts the chamfered surface 104 of the elongate opening 54 to move the plunger post 50 rearwardly such that the plunger face is in the position 56*a* of FIG. 8. By moving the post 54 rearwardly, the spring 68 is slightly compressed to ensure that there is tension at all times in the spring 68. Such slight compression of the spring 68 also ensures that when the dummy block is extracted from the container, the plunger 18 will pop out to facilitate separation of the dummy block from the butt of the billet. In accordance with this particular embodiment, the enlarged second diameter portion of the pin 96 locates the rearward portion 94 of the post in the correct position to compress the spring slightly. To maintain the position of the post or tapered pin 96 a threaded Allen screw 106 is threaded into the threaded bore 108 and contacts the top portion 110 of the tapered pin to hold it in place and hence maintain the plunger in place within the dummy block.

The replaceable collar of this dummy block construction provides many significant advantages while retaining all of the features and advantages of the dummy block construction of applicant's earlier U.S. Pat. No. 5,311,761 and as well the bayonet connection of their earlier U.S. Pat. No. 5,272,900. The collar 14 may be made of standard tool steel and optionally coated with wear resistant material to enhance the durability of the collar. it is also understood that the collar may be formed of steel which has a greater yield strength to accommodate the cyclical action of expansion and contraction due to the inward and outward telescopic movement of the plunger. By correctly defining the sloping portions of the plunger and the collar jamming of the two together during the cyclical operation of the dummy block is avoided. Preferably the angle is in the range of 20° to 25° relative to the longitudinally axis 110 of the dummy block construction. By provision of the strengthened collar 14 which is readily connected to and removed from the dummy block base, it is no longer necessary to return the dummy block base to the manufacturer for refurbishing. Instead, the dummy block base may simply have a worn collar removed therefrom and a new collar inserted thereon for resumption of extrusion. The collar may be readily located on the dummy block base by the use of a pin although it is understood that various other types of interconnecting devices may be used to ensure that the bayonet type connection of the collar to the dummy block base keeps the collar in place and does not allow it to float relative to the movement of the plunger head. If the collar were allowed to float relative to the plunger head, there is a greater chance that the collar could become jammed on the plunger head such that when the dummy block is retracted, the plunger head will not pop out of the dummy block base, hence jamming the dummy block in the container of the extruder. The system is also readily adapted for extruding higher temperature metals by use of a replaceable collar. The extruder may be used for the higher temperature metals by simply using a higher strength collar such as that made of Niconal (trademark). This permits ready change over of the less expensive dummy block base to the more expensive types of dummy blocks for extruding harder metal by simply replacing the collar.

Figure 9:
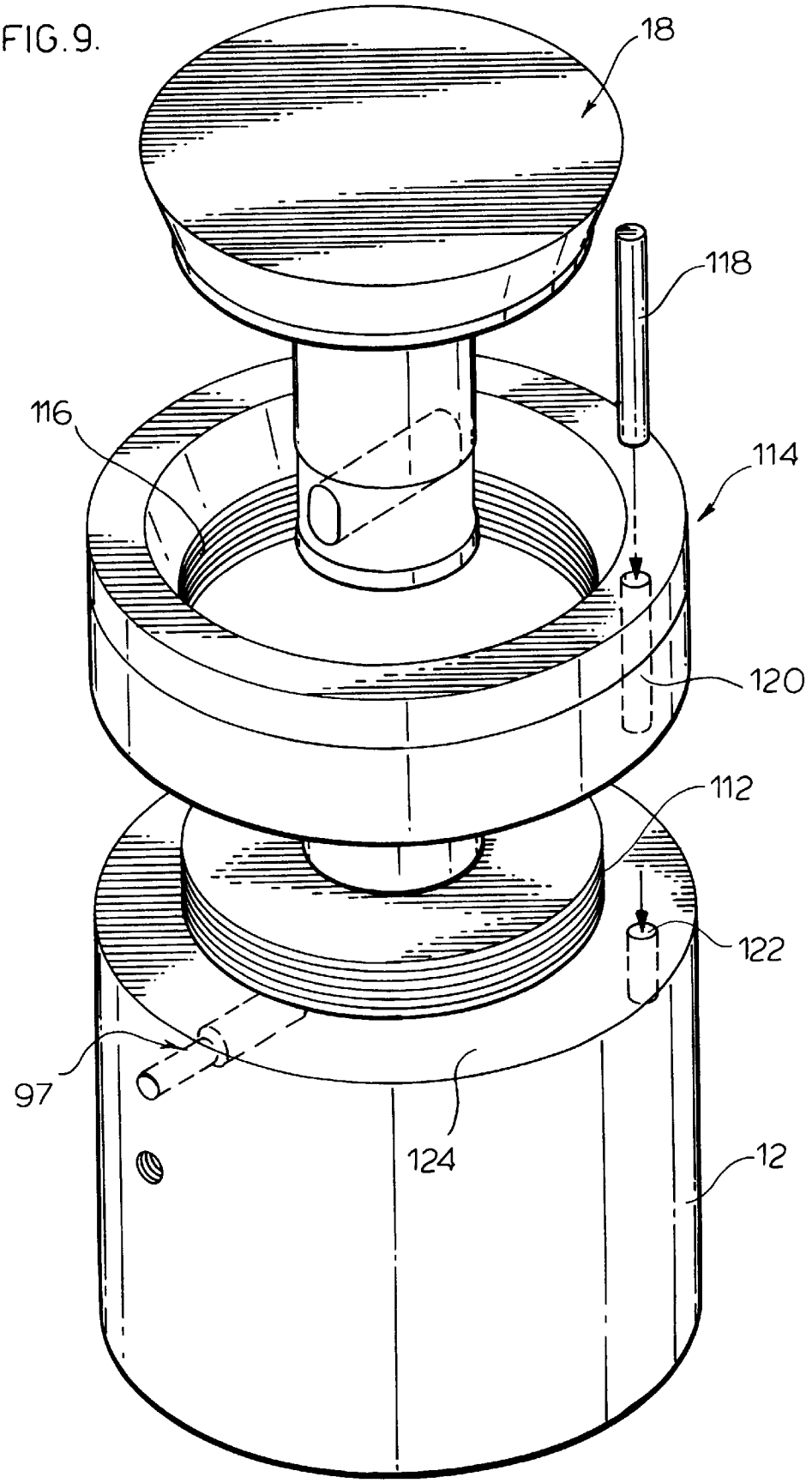
FIG. 9 shows an alternative embodiment for the collar connection to the dummy block base.
Figure 10:
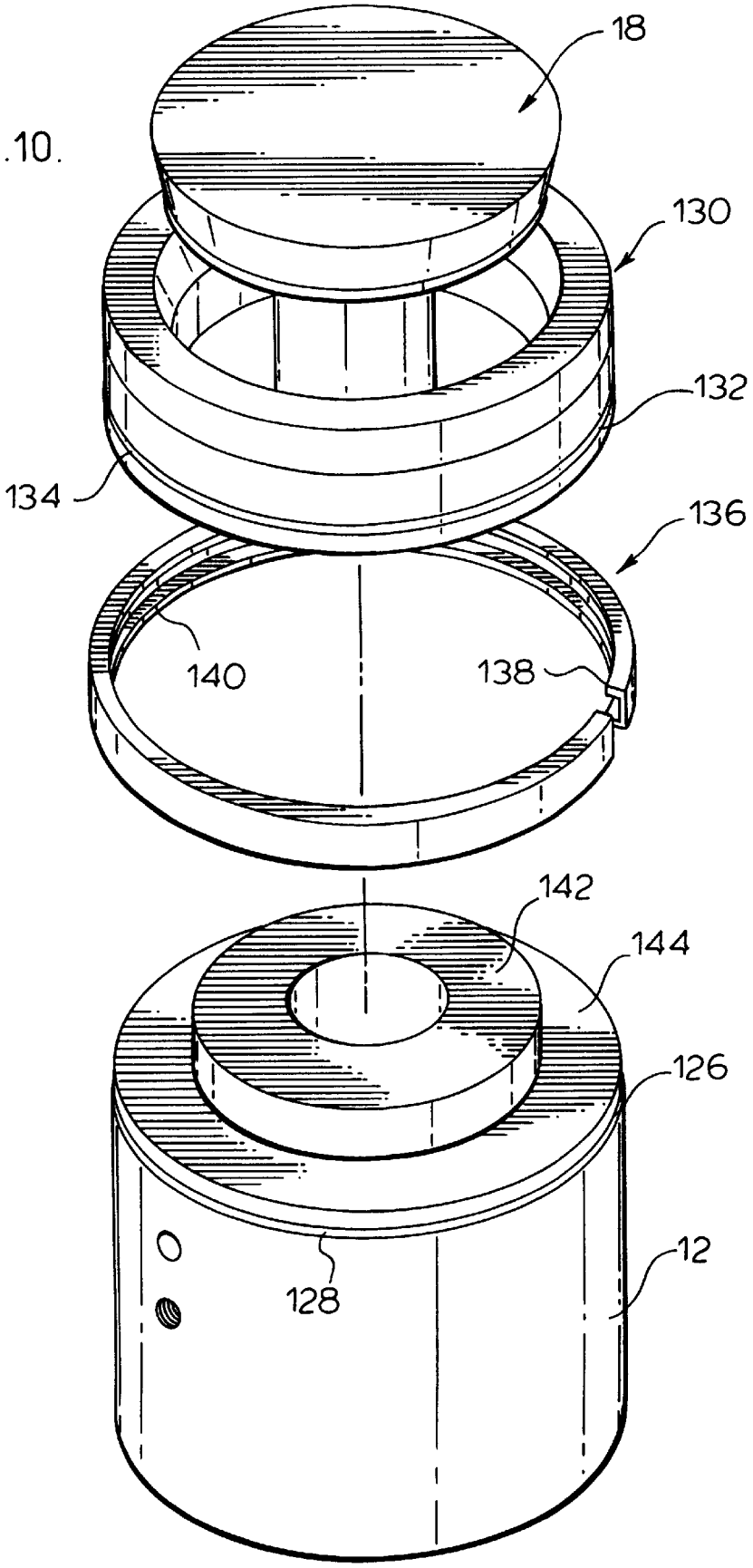
FIG. 10 shows an alternative embodiment for the connection of the collar to the dummy block base.

Various alternative embodiments for the collar mounting on the dummy block base are described with respect to FIGS. 9 and 10. As shown in FIG. 9, the dummy block base 12 is modified to include a threaded stub 112. The collar 114 has an internal threaded portion 116 which is threaded on the stub 112. The pin 118 as it passes through the bore 120 and into the dummy block base through the continuation of the bore 122 locates the threaded collar 114 on the dummy block base 12. The plunger 18 functions in the same manner and is secured within the dummy block base by a pin extending into the threaded aperture portion 97. Of course, the pin apertures 120 and 122 are normally formed in the dummy block after the collar 114 is threaded thereon to ensure that the collar 114 is snug against the face 124 of the dummy block base to ensure that excessive pressure is not exerted on the threads 112 and 116 of the dummy block base stub and the collar threaded portion 116.

A further alternative arrangement is shown in FIG. 10 where the dummy block base 12 has its outer periphery at 126 formed with a groove 128. Correspondingly, the collar 130 has a groove 132 formed in its outer peripheral portion 134. A connecting ring 136 having depending legs 138 and 140 are respectively fitted in grooves 132 and 128, when the collar is assembled about the stub 142 of the dummy block base 12. The ring 136 is wedged in place to keep the collar in position against the face 144 of the dummy block base and thereby ensure that the collar 130 is always in the correct operating position relative to the plunger 18.

As is appreciated, ideal operating conditions are not always provided during an aluminium extrusion work shift. During the work shift contaminants can build up within the billet container. The billet may be at varying temperature and lubrication of the dummy block may not always be at the optimum particularly, where the dummy block face abuts the face of the billet. Such unfavourable operating conditions can lead to additional stress applied to the dummy block not only during the extrusion cycle but as well in retracting the dummy block away from the spent billet and rearwardly through the extrusion container. In accordance with an aspect of this invention an alternative arrangement is provided for coupling the plunger within the dummy block which may have an integral, expandable periphery or have a replaceable collar and furthermore where tensioning of the biasing device in particular the spring, can be more acutely adjusted. With reference to FIG. 11 an alternative assembly is provided for connecting the plunger 150 within the dummy block 152 where in accordance with this embodiment, a replaceable collar 154 is provided. The collar 154 may be mounted on the cylindrical body portion 156 of the dummy block by use of the bayonet type connector generally designated 158 which is essentially the same as that described with respect to the bayonet connection for the collar of FIG. 1. The bayonet mounting 158 for the collar 154 may be pinned at 160 where the pin extends through the interconnecting lugs 162 and 164 to secure the position of the collar to the body 156 of the dummy block. This pin may be inserted before the plunger 150 is inserted in the dummy block 152.

The dummy block body portion 156 has a bore 166 of varying diameter to accommodate the various components in assembling the plunger 150 within the dummy block. The bore has an opening 168 at the bayonet connection 158 for the collar. At the other end of the dummy block body portion is an opening 170. Intermediate these two openings is an enlarged recess 172 to accommodate the head 174 of a bolt 176. The bore is reduced in area 178 to accommodate the shaft portion 180 of the bolt. The bore is enlarged at 182 to accommodate the spring 184 as well as the plunger post 186. The bolt shaft 180 has a threaded portion 188 which is threaded into the threaded blind hole 190 provided in the plunger post 186. A slot 192 is provided on the interior portion 194 of the plunger 150. The pin inserted at 160 has a head portion which is aligned with the slot 192 so as to fix the rotational position of the plunger in the body portion 156. The plunger is allowed to move inwardly and outwardly of the body portion but its rotational position is fixed by the pin being located in the slot 192 of the plunger. The slot 192 is sufficiently deep to permit the plunger moving into and out of the dummy block body portion as indicated by the distance 196 which is the separation between the rear portion 194 of the plunger and the front face 198 of the bayonet connector lugs 162. As is the case with the system of FIG. 2, the plunger moves inwardly and outwardly of the dummy block in order to expand the collar 154 to engage the container billet side or when its pops outwardly to allow the collar to resume its normal contracted position as shown in FIG. 11.

The device for biasing the plunger 150 outwardly of the dummy block is in accordance with this embodiment, a coil spring 184. With this connection assembly the coil spring surrounds the shaft 180 of the bolt and is positioned between the rear face 200 of the plunger post 186 and the base 202 of the recess 182. The coil spring 184 is a compression spring where a slight tension may be exerted on the spring by rotation of the bolt 176. As shown in FIG. 12, the bolt 176 has a head portion 174 with a tool socket 204 provided therein. In keeping with standard machine practice the tool socket 204 is commonly an Allen tool recess of the typical hexagon shape. The head 174 is readily accessible at the rearward portion 206 of the dummy block body so that one can readily rotate the bolt whereby the threads 188 threading into the threaded portion 190 of the plunger post draws the plunger post 186 towards the rear face 202 thereby compressing the spring 184. The number of turns of the bolt determines the extend of compression of the spring. By using a fine pitch for the threads, a single rotation of the bolt may move the piston post a fraction of a millimeter. The bolt head 174 is seated in the bore 166 by virtue of the land 173. The land 173 as it contacts the underside 175 of the bolt head 174 provides the necessary seating for the bolt such that when it is rotated the interengagement of the threads causes the plunger 150 to retract to within the collar 154.

As with the earlier embodiments, the spring is compressed to the extent that the plunger face 208 is held outwardly of the face 210 of the collar thereby providing the desired gap 212 between the conical surfaces. The extent of such a projection is indicated by arrows 214. Once the plunger is in the desired position and correspondingly the desired slight tensioning in the spring 184 is provided, the bolt position may be fixed by inserting a key 216 in the recess 218. The bolt head 174 includes a recess 220. When it is aligned with recess 218, the key 216 is inserted within the recess 218. When the plunger 115 is retracted within the collar 154 by pressing against the billet, the bolt moves rearwardly along with a compression of the spring 184 between faces 200 and 202. The key 216 is free to slide rearwardly while fixing the bolt from rotation. Correspondingly, the head of the pin slides within the recess 192 to prevent rotation of the plunger 150.

The tensioning of the spring is sufficient that when the plunger is pushed back within the collar during the extrusion stroke, then on the return stroke, the spring 184 has sufficient tension energy to pop the plunger 150 out from the collar 154 thereby allowing the collar 154 to collapse to its position shown in FIG. 11.

It has been found that under less than ideal operating conditions particularly where lubrication at the face of the dummy block is not always satisfactory, the face 208 of the dummy block plunger may stick to the face of the billet. Such sticking of the plunger face to the billet can exert excessive stress on the assembly when the dummy block is retracted during the return stroke of the extruder. It has been found that by providing a slight convex surface 222 on the plunger face 208, the plunger will readily release from the face of the billet. Furthermore, it has been found that with the slight convex curvature to the face 208, during commencement of the extrusion, the billet is allowed to move relative to the slightly bulged face to allow the billet to self position in the container as the system is settling in for the extrusion stroke. The very slight convex surface for the plunger is not unlike the shape for the plunger of the aforementioned German patent application 4,132,810. Albeit, in the German Patent, the convex shaped face is for a different purpose in preventing trapped gases and reducing bubbles at the face of the mandrel. As the face 208 moves when the plunger is retracted within the collar 154 to the working position, it is understood that the slight convex curvature of the face positions the plunger face slightly offset from the face 210 of the collar. That is, the two faces are not planar but are in essence essentially planar as described with respect to the embodiment of FIG. 2. Due to this slight convex shape for the face of the plunger where the movement of the plunger is designed to expand the ring 154, it is understood that the faces of the plunger and the collar 208 and 210 are considered to be substantially planar. Such substantially planar faces may include a slightly convex shape at least for the plunger face and as well a slight concave shape for the face of the collar and/or plunger.

Such convex or concave shape for the faces are only slight so as to not upset the interplay of the dummy block components during operation.

Figure 13:
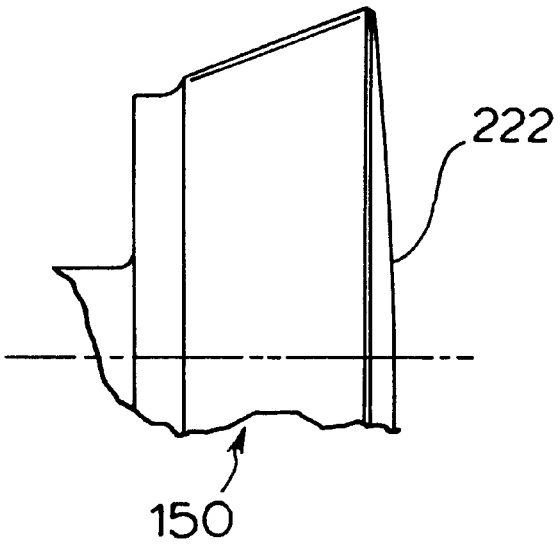
FIG. 13 is an enlarged view of an alternative shape for the plunger.
Figure 14:
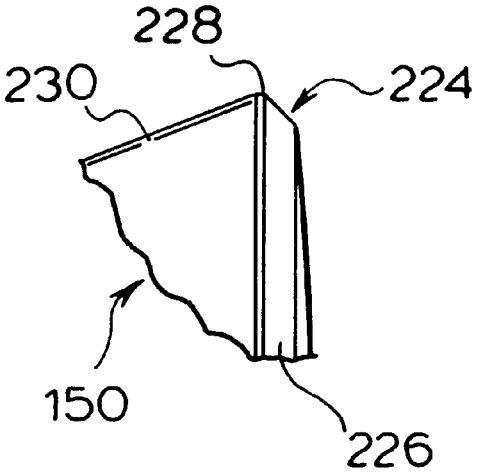
FIG. 14 is an enlarged view of the edge of the alternative shape for the plunger.

As shown in FIG. 13, the dummy block plunger 150 has a very slight curvature in face 222 where the curvature may have a radius of approximately 30 to 40 inches. Furthermore, as shown in FIG. 14, the edge 224 of the plunger 150 may have a slope 226 which leads to a narrow, flat 228 before the conical tapered surface 230.

When the plunger is in the retracted operating position the face 220 of the collar may be aligned with the narrow, flat portion 228 of the plunger.

In view of the dummy block operating under less than favourable conditions, the bolt 176 may be formed of a metal material which has a very high tensile yield, The bolts should have a tensile yield in excess of 200,000 psi and preferably in excess of 350,000 psi. Bolts having such tensile yields are available from companies such as the Marquardt Company and sold under the trade mark Vasco-MAX (trademark). A selected material for the bolt may be that of VacsoMAX-350.

With the assembly of FIG. 11, it is apparent that the bayonet connector portion 232 may be integral with the dummy body portion 156. By use of the bolt 176 extending through the bore 166, there is no need for the connector 232 to be a separate component. Any desired play for the connector 232 within the stem can be accommodated by the mating connector component in the stem end. As already noted, the preferred connector for connecting the dummy block to the stem is the bayonet style connector of the type described in U.S. Pat. No. 5,272,900 in alternative thereto.

By forming the connector 232 integrally with the dummy block there are considerable cost savings. The dummy block body portion 156 is now readily machined from a single piece of material using a multi-stage lathe, where such machining does not require any threading on the inside or the outside of the dummy block structure. Instead the bayonet connections 156 for the collar may be machined in the single piece as well as the connector 232. The bore can be readily formed within the body and of various diameters to accommodate the plunger post, coil spring, bolt shaft and bolt head. Not only does the use of the bolt type connection for the plunger facilitate machining of the body portion of the dummy block and hence reduce costs, but as well facilitates assembly, disassembly and re-assembly of the dummy block during replacement of the collar 154. The use of the bolt connection system also allows for a single piece dummy block construction for use in connecting the earlier style plungers within the dummy block such as those described in Degen U.S. Pat. No. 4,550,584 and applicant's U.S. Pat. No. 5,311,761.

Although preferred embodiments of the invention are described herein in detail, it will be understood by those skilled in the art that variations may be made thereto without departing from the spirit of the invention or the scope of the appended claims.

I claim:

1. In a dummy block construction for use in extruding an extrudable metal, said dummy block having:

i) dummy block base;

ii) means for connecting said dummy block base to a stem of an extruder;

iii) a metal plunger for expanding said dummy block to engage a billet container inside wall of an extrusion press during extrusion of a billet of extrudable metal through such extrusion press;

iv) means for mechanically biasing said plunger head to pop outwardly of said dummy block;

v) a bore extending axially through said dummy block;

vi) said biasing means located in said bore and positioned to bias a plunger post extending into said bore;

the improvement comprising vii) said connecting means being integral with said dummy block base, said bore extending through said dummy block and said connecting means, and viii) a bolt having a head and a threaded end extending through said bore and threaded into said plunger post, said bore having rearward of said dummy block means for seating said bolt head in said bore, whereby turning of said bolt retracts said plunger post into said dummy block to tension slightly said biasing means.

2. A dummy block construction for use in extruding an extrudable metal, said dummy block having:

a dummy block base;

means for connecting said dummy block base to a stem of an extruder;

a replaceable wear ring connected to a forward circumferential portion of said dummy block base;

means for releasably securing said wear ring to said dummy block base;

means for expanding said ring to engage a billet container inside wall of an extrusion press during extrusion of a billet of extrudable metal through such extrusion press;

said wear ring being a metal collar having a conical interior surface converging towards said dummy block base;

said means for expanding said ring comprising a metal plunger having a plunger head with a conical surface for engaging said collar conical surface to expand said collar as said plunger head is forced into said collar during extrusion;

said plunger head having a substantially planar face and said collar having a forward substantially planar face;

said converging surfaces of said collar and said plunger head extending a sufficient distance to permit telescoping of said plunger head into said collar to an extent which expands said collar to engage such billet container inside wall whereby said plunger face is essentially planar with said face of said collar, said plunger having a post extending into said dummy block base, means provided in said dummy block base for mechanically biasing said plunger head outwardly of said collar, said mechanical biasing means having sufficient biasing force to pop said plunger head outwardly of said collar when said dummy block is withdrawn from an extrusion press container to allow said collar to collapse, said dummy block base has a cylindrical body portion with an axially extending bore, said connecting means for connecting said dummy block to an extruder stem being provided on a rearward portion of said dummy block with said bore extending therethrough, said plunger having a post extending into said dummy block base through a forward portion of said bore, said biasing means being located in said bore and positioned to bias said plunger, means for releasably retaining said post in said bore, said retaining means being accessible from said rearward portion of said dummy block, said retaining means comprising a bolt extending through said bore, said bolt being connected to said post and means for seating a bolt head in said bore, said bolt having means for retracting said plunger post into said dummy block bore to tension slightly said biasing means, said bolt head being accessible from said rearward portion of said dummy block.

3. In a dummy block construction of claim 2, said substantially planar face of said plunger head having a convex surface to define a slightly bulging face.

4. In a dummy block construction of claim 2, said biasing means being a coil spring, said bolt extends through said coil spring and said means for retracting said plunger post being a threaded bolt end which is threaded into said plunger post, rotation of said bolt retracting plunger post into said dummy block.

5. In a dummy block construction of claim 3, said connecting means for connecting said dummy block to said stem is integral with said dummy block, said bore extending through said connecting means where said bolt head is provided with a recessed tool socket to facilitate turning of said bolt to retract said plunger post.

6. In a dummy block construction of claim 5, said bolt tensile yield is in excess of 200,000 psi.

7. In a dummy block construction of claim 6 said bolt tensile yield is approximately 350,000 psi.

* * * * *